US007901475B2

(12) United States Patent
Gonze et al.

(10) Patent No.: US 7,901,475 B2
(45) Date of Patent: Mar. 8, 2011

(54) DIESEL PARTICULATE FILTER WITH ZONED RESISTIVE HEATER

(75) Inventors: Eugene V. Gonze, Pinckney, MI (US); Michael J. Paratore, Jr., Howell, MI (US)

(73) Assignee: GM Global Technology Operations, Inc.

( * ) Notice: Subject to any disclaimer, the term of this patent is extended or adjusted under 35 U.S.C. 154(b) by 442 days.

(21) Appl. No.: 12/052,057

(22) Filed: Mar. 20, 2008

(65) Prior Publication Data

US 2009/0183501 A1 Jul. 23, 2009

Related U.S. Application Data

(60) Provisional application No. 61/022,047, filed on Jan. 18, 2008.

(51) Int. Cl.

| | |
|---|---|
| ***B01D 39/00*** | (2006.01) |
| ***B01D 39/14*** | (2006.01) |
| ***B01D 39/06*** | (2006.01) |
| ***B01D 50/00*** | (2006.01) |

(52) U.S. Cl. ..... 55/282.3; 55/522; 55/523; 55/524; 422/169; 422/170; 422/171; 422/172; 422/177; 422/178; 422/179; 422/180; 422/181; 422/182

(58) Field of Classification Search ..... 55/282.3, 55/522–524; 422/168–172, 177–182
See application file for complete search history.

(56) References Cited

U.S. PATENT DOCUMENTS

| | | | | |
|---|---|---|---|---|
| 4,505,726 | A | 3/1985 | Takeuchi | |
| 4,516,993 | A | 5/1985 | Takeuchi | |
| 5,399,531 | A * | 3/1995 | Wu | 700/112 |
| 5,534,471 | A * | 7/1996 | Carolan et al. | 502/4 |
| 6,176,896 | B1 * | 1/2001 | Dementhon et al. | 95/14 |
| 7,459,013 | B2 * | 12/2008 | Holmes et al. | 96/132 |
| 7,686,857 | B2 * | 3/2010 | Gonze et al. | 55/282.3 |
| 2005/0218003 | A1 * | 10/2005 | Wang et al. | 205/157 |
| 2005/0249643 | A1 * | 11/2005 | Arno | 422/172 |
| 2007/0062181 | A1 * | 3/2007 | Williamson et al. | 60/297 |
| 2008/0102011 | A1 * | 5/2008 | Moalem et al. | 423/240 R |

OTHER PUBLICATIONS

U.S. Appl. No. 11/233,450, filed Nov. 22, 2005, Weldon Williamson.

* cited by examiner

*Primary Examiner* — Walter D Griffin
*Assistant Examiner* — Amber Orlando

(57) ABSTRACT

A diesel particulate filter assembly comprises a diesel particulate filter (DPF) and a heater assembly. The DPF filters a particulate from exhaust produced by an engine. The heater assembly has a first metallic layer that is applied to the DPF, a resistive layer that is applied to the first metallic layer, and a second metallic layer that is applied to the resistive layer. The second metallic layer is etched to form a plurality of zones.

14 Claims, 6 Drawing Sheets

DIESEL PARTICULATE FILTER WITH ZONED RESISTIVE HEATER

CROSS-REFERENCE TO RELATED APPLICATIONS

This application claims the benefit of U.S. Provisional Application No. 61/022,047, filed on Jan. 18, 2008. The disclosure of the above application is incorporated herein by reference in its entirety.

STATEMENT OF GOVERNMENT RIGHTS

This invention was produced pursuant to U.S. Government Contract No. DE-FC-04-03 AL67635 with the Department of Energy (DoE). The U.S. Government has certain rights in this invention.

FIELD

The present disclosure relates to vehicle emissions and more particularly to diesel particulate filters.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Diesel engines typically produce torque more efficiently than gasoline engines. This increase in efficiency may be due to an increased compression ratio and/or the combustion of diesel fuel, which has a higher energy density than that of gasoline. The combustion of diesel fuel produces particulate. The particulate is filtered from exhaust gas using a diesel particulate filter (DPF). With time, the DPF may fill with particulate, thereby restricting the flow of the exhaust gas. The particulate may be combusted by a process referred to as regeneration.

Regeneration may be accomplished, for example, by injecting fuel into the exhaust gas after the combustion of the diesel fuel. One or more catalysts may be disposed in the stream of the exhaust gas and may combust the injected fuel. The combustion of the fuel by the catalysts generates heat, thereby increasing the temperature of the exhaust gas. The increased temperature of the exhaust gas may burn the remainder of the particulate trapped in the DPF.

SUMMARY

A diesel particulate filter assembly comprises a diesel particulate filter (DPF) and a heater assembly. The DPF filters a particulate from exhaust produced by an engine. The heater assembly has a first metallic layer that is applied to the DPF, a resistive layer that is applied to the first metallic layer, and a second metallic layer that is applied to the resistive layer. The second metallic layer is etched to form a plurality of zones.

In other features, the diesel particulate filter assembly further comprises an end plug that is inserted into the second metallic layer to close a channel of the DPF. The resistive layer is disposed downstream of the end plug.

In further features, the first metallic layer is applied to the DPF by dip-coating. The first metallic layer is embedded into a wall of the DPF.

In still further features, the resistive layer is applied to the first metallic layer by dip-coating.

In other features, the second metallic layer is applied to the resistive layer by dip-coating.

A system comprises the diesel particulate filter assembly and a heater power module. The heater power module is in electrical communication with each of the zones and selectively applies at least one of a voltage and a current to selected ones of the zones.

A method comprises applying a first metallic layer to a diesel particulate filter (DPF), applying a resistive layer to the first metallic layer, applying a second metallic layer to the resistive layer, and etching the second metallic layer into a plurality of zones.

In further features, the method further comprises inserting an end plug into the second metallic layer to close a channel of the DPF. The resistive layer is disposed downstream of the end plug.

In still further features, the first metallic layer is applied to the DPF by dip-coating. The applying the first metallic layer to the DPF embeds the first metallic layer into a wall of the DPF.

In other features, the resistive layer is applied to the first metallic layer by dip-coating.

In still other features, the second metallic layer is applied to the resistive layer by dip-coating.

In further features, the method further comprises selecting ones of the zones and selectively applying at least one of a voltage and a current to the selected ones of the zones.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
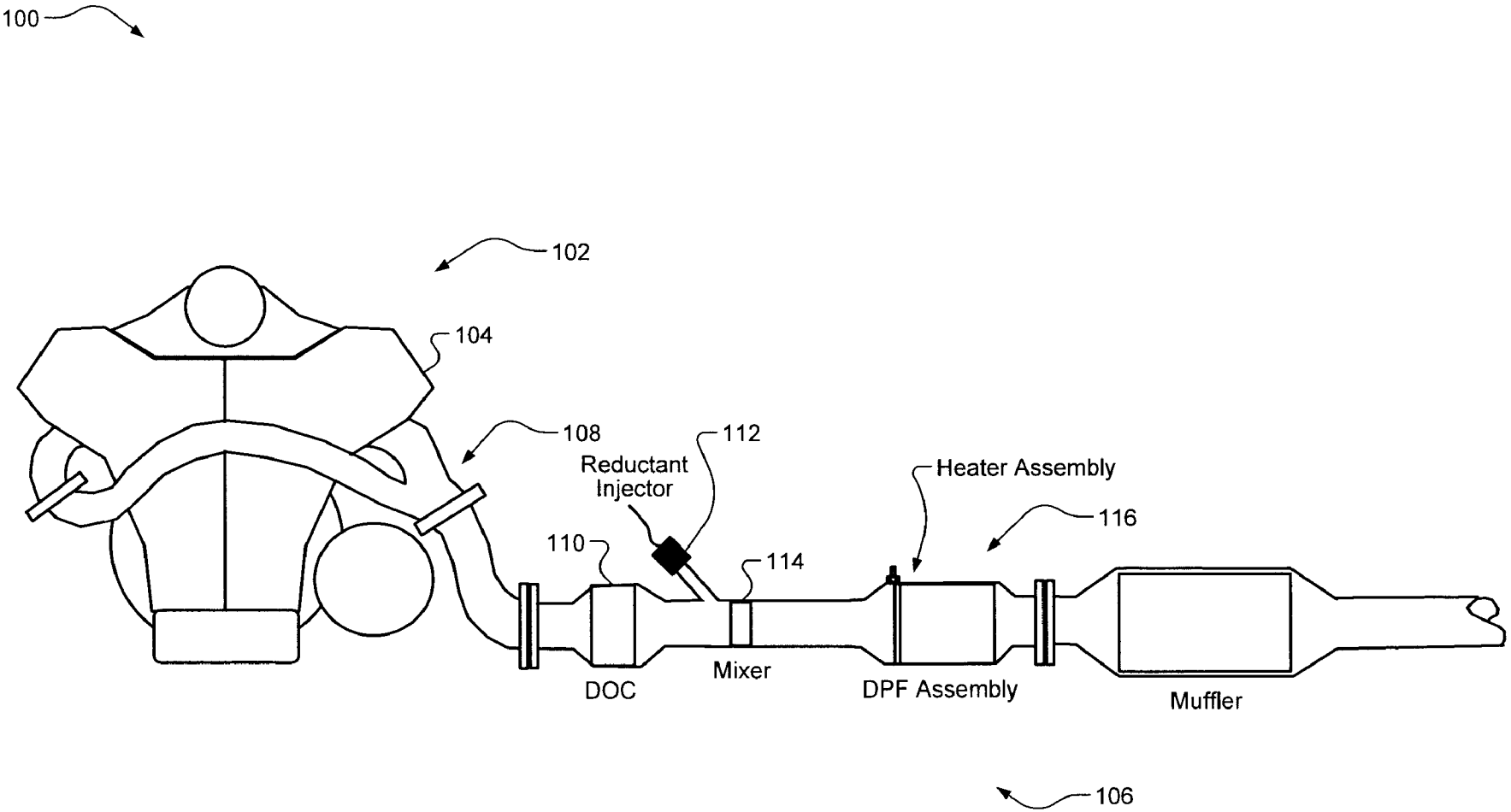
FIG. 1 is a functional block diagram of an exemplary engine system and exhaust system according to the principles of the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

Referring now to FIG. 1, a functional block diagram of an exemplary engine and exhaust system 100 for a vehicle is presented. The vehicle includes a diesel engine system 102. While the diesel engine system 102 is described, the present disclosure is applicable to gasoline engine systems, homogenous charge compression ignition engine systems, and/or other engine systems.

The diesel engine system 102 includes an engine 104 and an exhaust system 106. The engine 104 combusts a mixture of air and diesel fuel to produce torque. Resulting exhaust gas is expelled from the engine 104 into the exhaust system 106. The exhaust system 106 includes an exhaust manifold 108, a diesel oxidation catalyst (DOC) 110, a reductant injector 112, a mixer 114, and a diesel particulate filter (DPF) assembly 116. The exhaust system 106 may also include an exhaust gas recirculation (EGR) valve (not shown) that may recirculate a portion of the exhaust gas back to the engine 104.

The exhaust gas flows from the engine 104 through the exhaust manifold 108 to the DOC 110. The DOC 110 oxidizes particulate in the exhaust gas as the exhaust gas flows through the DOC 110. For example only, the DOC 110 may oxidize particulate such as hydrocarbons and/or carbon oxides. The reductant injector 112 may inject a reductant, such as ammonia or urea, into the exhaust system 106. The mixer 114, which may be implemented as a baffle, agitates the exhaust gas and/or the injected reductant. In this manner, the mixer 114 may create a reductant-exhaust aerosol by mixing the reductant with the exhaust gas.

The DPF assembly 116 filters particulate from the exhaust gas passing through it. This particulate may accumulate within the DPF assembly 116 and may restrict the flow of exhaust gas through the DPF assembly 116. The particulate may be removed from the DPF assembly 116 by a process referred to as regeneration. Discussion of a DPF assembly and the regeneration process can be found in commonly assigned U.S. patent application Ser. No. 11/233,450, filed Nov. 22, 2005, which is herein incorporated by reference in its entirety.

Figure 2A:
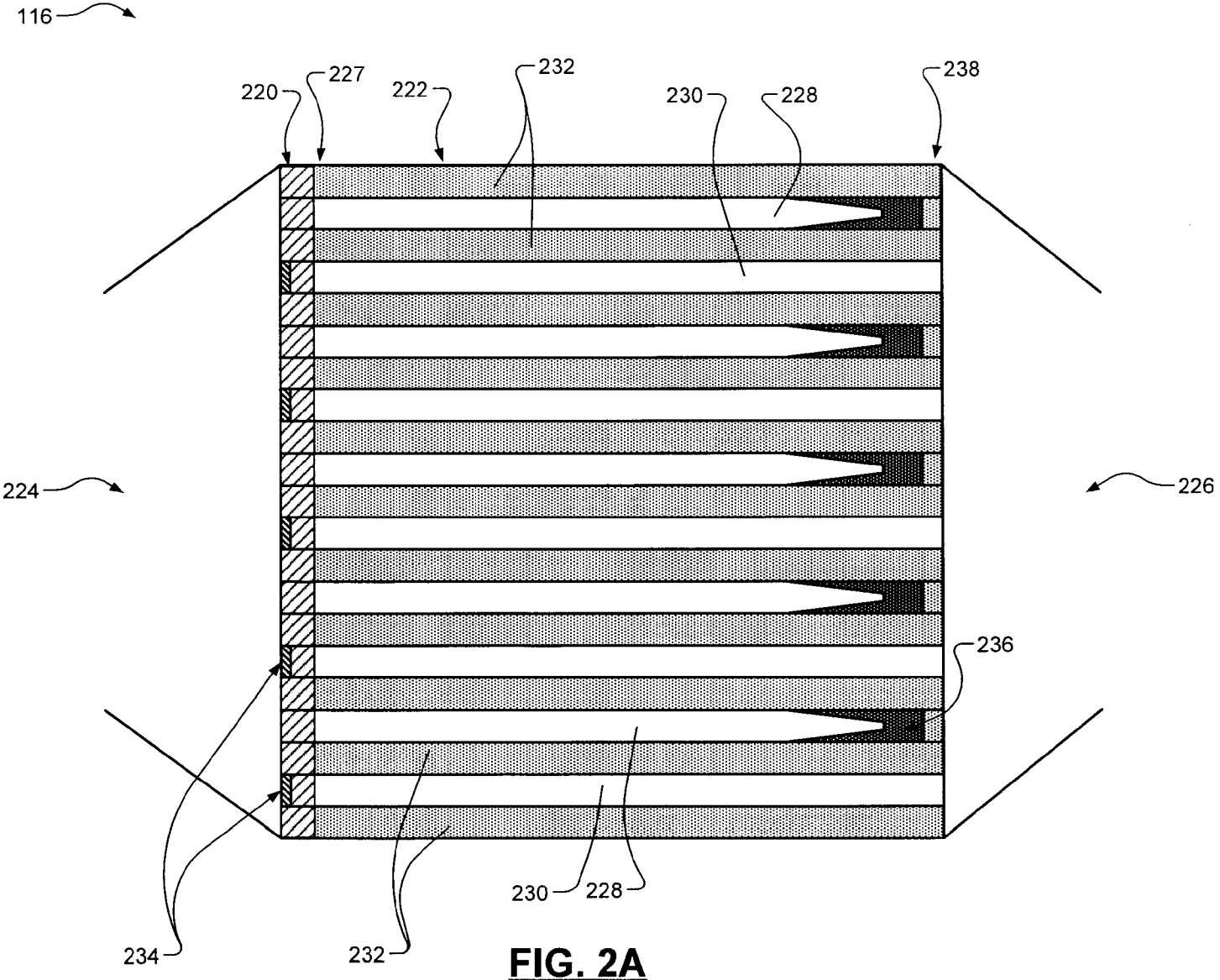
FIG. 2A is a cross-sectional view of an exemplary diesel particulate filter assembly according to the principles of the present disclosure.

Referring now to FIG. 2A, a cross-sectional view of an exemplary implementation of the DPF assembly 116 is presented. The DPF assembly 116 includes a heater assembly 220 and a diesel particulate filter (DPF) element 222. The exhaust gas enters the DPF assembly 116 through an inlet 224 and flows through the heater assembly 220 and then the DPF element 222. The exhaust gas exits the DPF assembly 116 though an outlet 226.

The exhaust gas enters the DPF element 222 through a front section 227 of the DPF element 222. The DPF element 222 may include alternating open channels 228 and closed channels 230 that force the exhaust gas through walls 232 of the DPF element 222. The arrangement of the closed channels 230 and the open channels 228 may be chosen to make the flow of the exhaust gas through the DPF element 222 more laminar (i.e., straighter).

The walls 232 of the DPF element 222 may be porous, may be arranged in a honeycomb fashion, and may be made of, for example, a ceramic or cordierite material. The walls 232 of the DPF element 222 filter particulate from the exhaust gas. As particulate is filtered, the particulate may accumulate within the DPF element 222, as shown at 236. The exhaust gas exits the DPF element 222 via a rear section 238.

The regeneration process (i.e., combustion of particulate) may begin once the heater assembly temperature reaches a threshold temperature, such as 800° C. Particulate on and/or passing the heater assembly 220 is then combusted, generating heat. The exhaust gas carries this heat from the front section 227 to the rear section 238, thereby combusting particulate throughout the DPF element 222.

A selective catalytic reductant (SCR) catalyst (not shown) may be applied to all of or a portion of the DPF element 222. For example only, the SCR catalyst may be applied to the front section 227, the walls 232, and/or the rear section 238 of the DPF element 222. The SCR catalyst may be applied to the DPF element 222 in any pattern, such as striped, and the SCR catalyst may be applied in varying degrees. For example only, the SCR catalyst may be applied more heavily toward the rear section 238 of the DPF element 222.

The SCR catalyst absorbs reductant injected by the reductant injector 112 and reacts with nitrogen oxides ($NO_X$) and/or other pollutants in the exhaust gas. In this manner, the SCR catalyst reduces the $NO_X$ emissions of the vehicle. The SCR catalyst may be effective in reducing (reacting with) $NO_X$ once the temperature of the SCR catalyst exceeds a threshold. For example only, the threshold may be 200° C. If the reductant is injected when the SCR temperature is below the threshold, the reductant may compromise the function of the SCR catalyst. Heat provided by the heater assembly 220 may be used to warm the SCR catalyst.

Figure 2C:
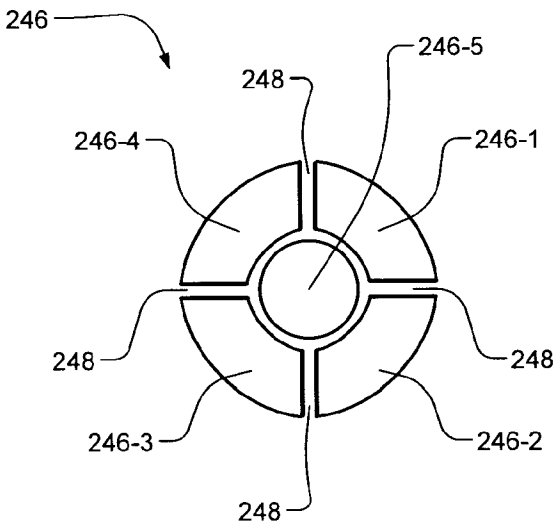
FIG. 2C is an enlarged view of an exemplary zone arrangement of the heater assembly according to the principles of the present disclosure.
Figure 2B:
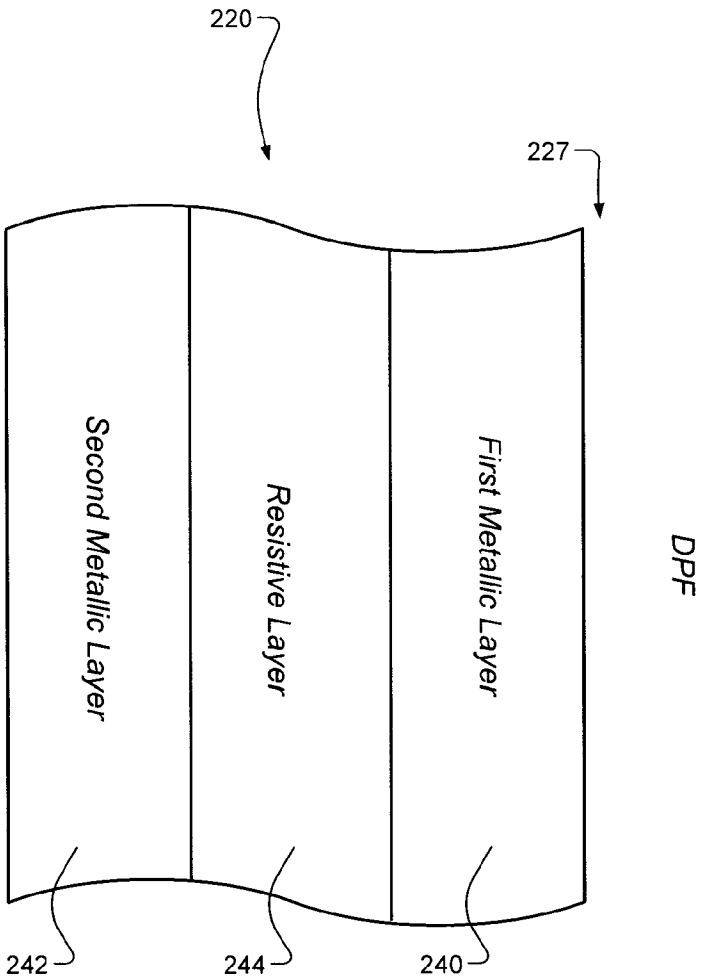
FIG. 2B is an enlarged, cross-sectional view of an exemplary heater assembly according to the principles of the present disclosure.

Referring now to FIG. 2B, an exemplary enlarged, cross-sectional view of the heater assembly 220 is presented. The heater assembly 220 includes a first metallic layer 240, a second metallic layer 242, and a resistive layer 244. The first metallic layer 240, the second metallic layer 242, and the resistive layer 244 may be any suitable thickness. While the layers are shown in FIG. 2B as being approximately equal in thickness, the thickness of each of the layers may vary.

The first metallic layer 240 is applied to the front section 227 of the DPF element 222. The first metallic layer 240 may be applied to the front section 227 in any suitable manner, such as by dip-coating. As the walls 232 of the DPF element 222 may be porous, the first metallic layer 240 may be partially embedded or infused in the walls 232. The metallic substance of the first metallic layer 240 may be any suitable electrically-conductive metallic substance and may be applied in any suitable thickness.

The resistive layer 244 is applied to the first metallic layer 240. The resistive layer 244 may be applied to the first metallic layer 240 in any suitable manner, such as by dip-coating. The resistive layer 244 may include any suitable electrically-resistive substance and may be applied in any suitable thickness.

The second metallic layer 242 is applied to the resistive layer 244. In this manner, the second metallic layer 242 is electrically connected to the first metallic layer 240 via the resistive layer 244. The second metallic layer 242 may be applied to the resistive layer 244 in any suitable manner, such as by dip-coating. The metallic substance of the second metallic layer 242 may be any suitable electrically-conductive metallic substance and may be applied in any suitable thickness.

Referring again to FIG. 2A, the closed channels 230 are closed by end plugs 234. The end plugs 234 may be inserted into the second metallic layer 242 to create the closed channels 230. The thickness of the second metallic layer 242 may be specified relative to the length of the end plugs 234. For example only, as shown in FIG. 2A, the thickness of the second metallic layer 242 may be greater than the length of the end plugs 234. In other implementations the thickness of the second metallic layer 242 may be equal to the length of the end plugs 234. Accordingly, the resistive layer 244 is disposed downstream of the end plugs 234.

Referring now to FIG. 2C, an enlarged view of an exemplary zone arrangement of the heater assembly 220 is presented. The second metallic layer 242 is formed into a plurality of zones 246. For example only, the second metallic layer 242 may be formed into N zones, 246-1, 246-2, . . . , 246-N, collectively. While the second metallic layer 242 is depicted in FIG. 2C as being formed into five zones (N=5) 246-1-246-5, the second metallic layer 242 may be formed into any suitable number of zones and the zones 246 may be arranged in any suitable configuration.

The zones 246 may be formed in any suitable manner, such as by etching the zones 246 into the second metallic layer 242. Etching the second metallic layer 242 into the zones 246 creates a void 248, which separates each of the zones 246 from each of the other zones. In this manner, each of the zones 246 is electrically isolated from each other zone of the heater assembly 220.

The dimensions (width and depth) of the void 248 may be specified to ensure that each of the zones 246 is electrically isolated from each other zone. For example, the void 248 is etched completely through the second metallic layer 242. Accordingly, the depth of the void 248 is greater than or equal to the thickness of the second metallic layer 242. The width of the void 248 may be specified to ensure that power applied to one of the zones 246 cannot transfer to any other zone.

Figure 3:
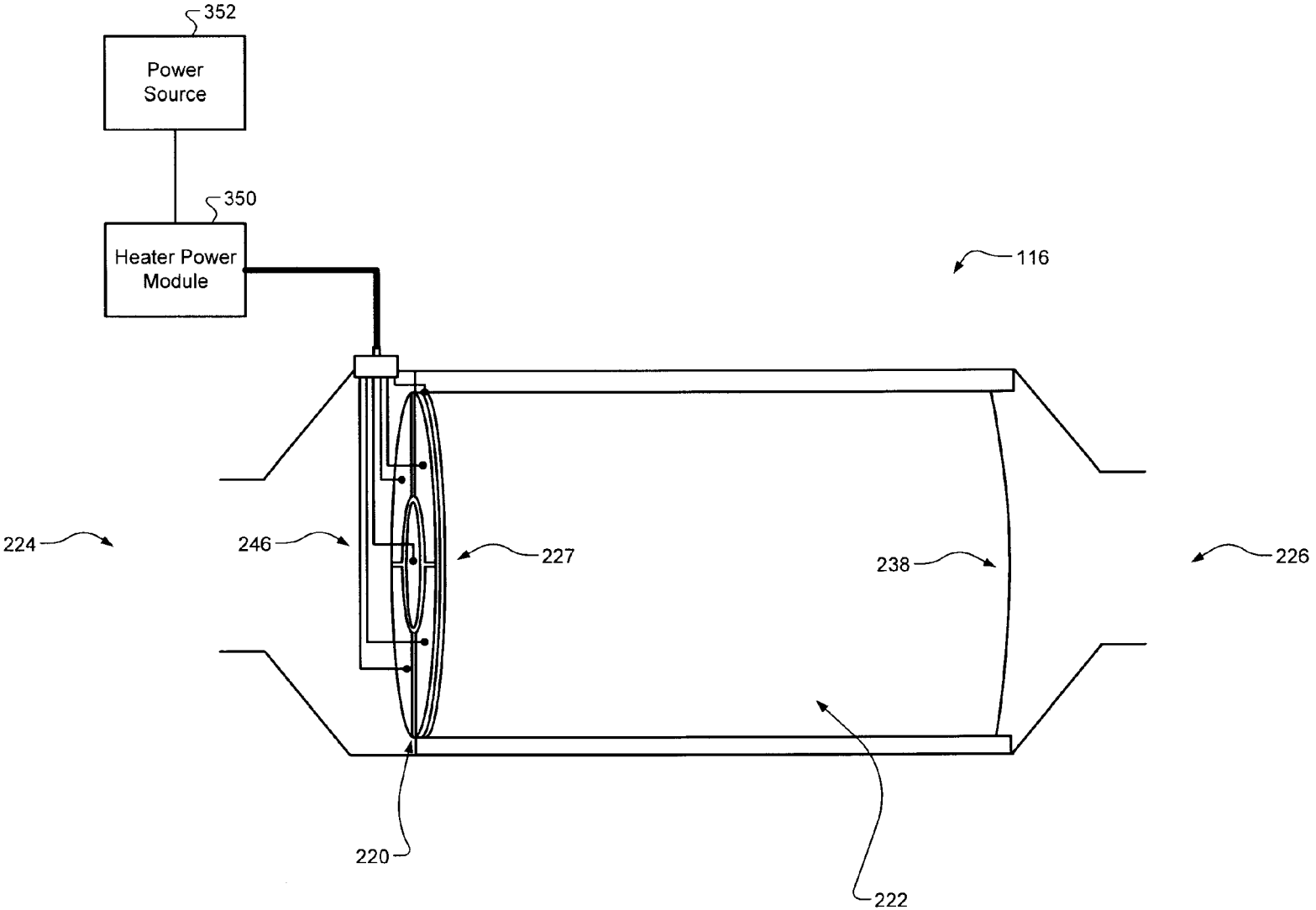
FIG. 3 is another cross-sectional view of a diesel particulate filter with a zoned resistive heater assembly according to the principles of the present disclosure.

Referring now to FIG. 3, a cross-sectional view of an exemplary diesel particulate filter with the heater assembly 220 is presented. Each of the zones 246 of the heater assembly 220 is connected to a heater power module 350. The first metallic layer 240 is connected to a ground source.

The heater power module 350 selectively applies power from a power source 352 to one or more selected zones. For example only, the power source 352 may include an alternator and/or a battery. Applying power to selected zones instead of to the heater assembly 220 as a whole may limit the amount of power that is drawn from the power source 352 at any one time. In various implementations, the heater power module 350 may be implemented in an engine control module (not shown).

Power applied to a zone of the second metallic layer 242 flows from that zone of the second metallic layer 242 to the first metallic layer 240 via the resistive layer 244. Heat (resistive heat) is generated as power flows through the resistive layer 244. This heat may be used to, for example, warm the SCR catalyst and/or to warm that zone to the threshold temperature to begin the regeneration process. Additionally, the heat may warm the other zones of the heater assembly 220.

As stated above, the resistive layer 244 is downstream of the end plugs 234. In this manner, the zones 246 provide heat downstream of the end plugs 234. Providing heat downstream of the end plugs 234 may help minimize heat losses attributable to flow of the exhaust gas as the flow of the exhaust gas may be more turbulent near the end plugs 234.

The heater power module 350 may apply power to the zones 246 in any suitable order. For example only, the heater power module 350 may apply power to the zones 246 in a predetermined order or pattern. The predetermined order or pattern may be specified to, for example, minimize the time necessary to complete the regeneration process. For example only, the heater power module 350 may first apply power to the zone 246-5. As the zone 246-5 is depicted in FIG. 2C as being in a central location, heat generated by the zone 246-5 may warm the other zones 246-1-246-4. This warming may reduce the time necessary for the other zones 246-1-246-4 to reach the threshold temperature.

Figure 4:
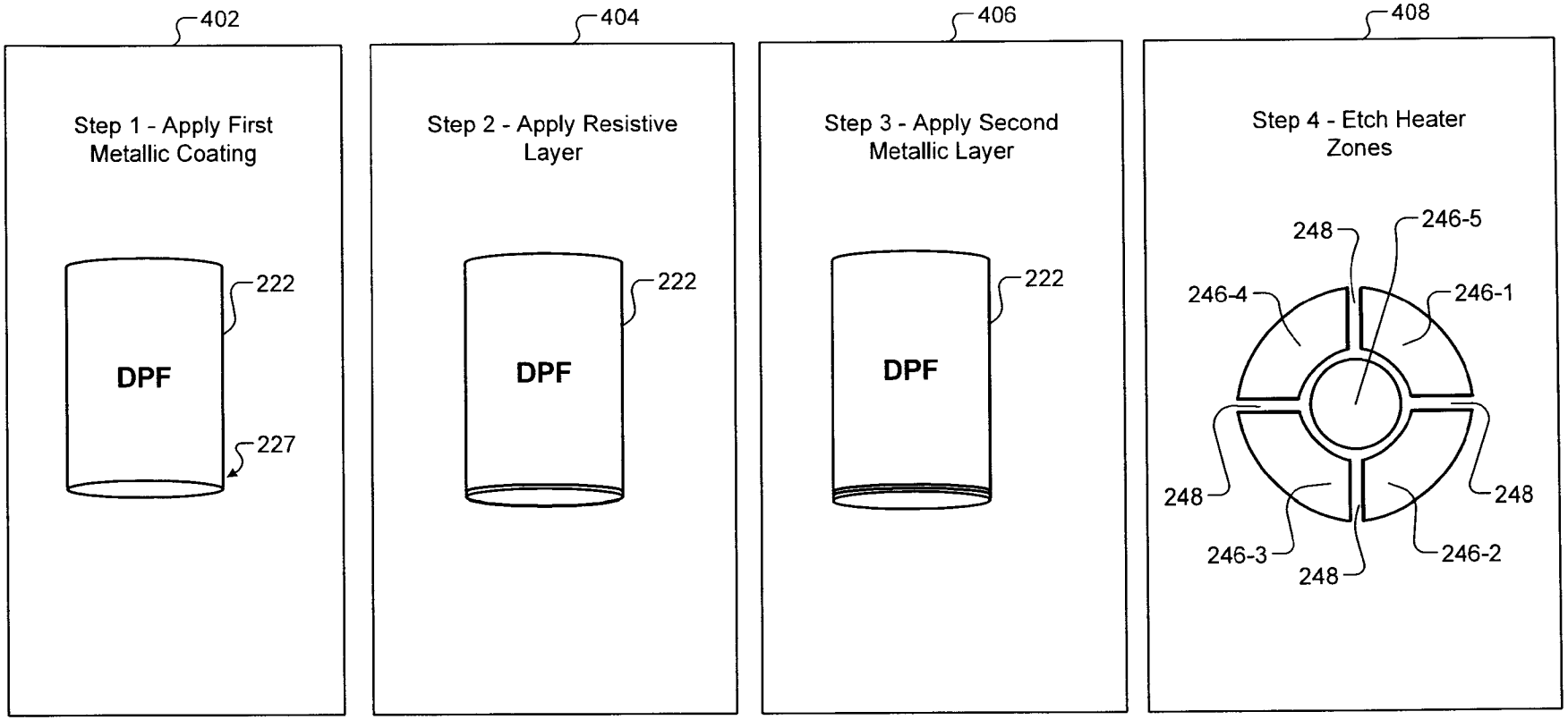
FIGS. 4-5 are illustrated exemplary methods for making the diesel particulate filter with the zoned resistive heater assembly according to the principles of the present disclosure.

Referring now to FIG. 4, an exemplary method for making the diesel particulate filter with the zoned resistive heater assembly is presented. Diagram 402 depicts an exemplary illustration of the DPF element 222. First, the first metallic layer 240 is applied to the DPF element 222. More specifically, the first metallic layer 240 is applied to the front section 227 of the DPF element 222.

The first metallic layer 240 may be applied in any suitable manner. For example only, the metallic substance of the first metallic layer 240 may be dip-coated onto the front section 227 of the DPF element 222. As the walls 232 of the DPF element 222 may be porous, the first metallic layer 240 may be partially infused into the walls 232. The first metallic substance may be any suitable electrically-conductive metallic substance.

In various implementations, a buffer substance (not shown), may be used to isolate the first metallic layer 240 from the second metallic layer 242. For example only, the buffer substance may be a silicone substance. In various implementations, the buffer substance may be disposed between the first metallic layer 240 and the resistive layer 244. The buffer substance is later removed by, for example, calcination.

Diagram 404 depicts an exemplary illustration of the DPF element 222 with the first metallic layer 240 applied. After the first metallic layer 240 is applied, the resistive layer 244 is applied to the first metallic layer 240. The resistive substance of the resistive layer 244 may be applied to the first metallic layer 240 in any suitable manner. For example only, the resistive substance of the resistive layer 244 may be dip-coated onto the first metallic layer 240. The resistive substance of the resistive layer 244 may be any suitable electrically-resistive substance.

Diagram 406 depicts an exemplary illustration of the DPF element 222 with the first metallic layer 240 and the resistive layer 244 applied. The second metallic layer 242 is applied to the resistive layer 244. In this manner, the second metallic layer 242 is in electrical communication with the first metallic layer 240 via the resistive layer 244.

The metallic substance of the second metallic layer 242 may be applied to the resistive layer 244 in any suitable manner. For example only, the metallic substance of the second metallic layer 242 may be dip-coated onto the resistive layer 244. The metallic substance of the second metallic layer 242 may be any suitable electrically-conductive metallic substance. The metallic substance of the second metallic layer 232 may be similar or identical to the metallic substance of the first metallic layer 240.

Diagram 408 depicts an exemplary an exemplary zone arrangement of the heater assembly 220. The second metallic layer 242 is formed into zones, such as the zones 246. The zones 246 may be arranged in any suitable configuration. The zones 246 may be formed in any suitable manner, such as by etching the zones 246 into the second metallic layer 242. Forming of the zones 246 creates one or more voids in the second metallic layer 242, such as the void 248. The void 248 electrically isolates each of the zones 246 from each other zone. In various arrangements, one or more additional voids may be formed to create a zone arrangement.

Figure 5:
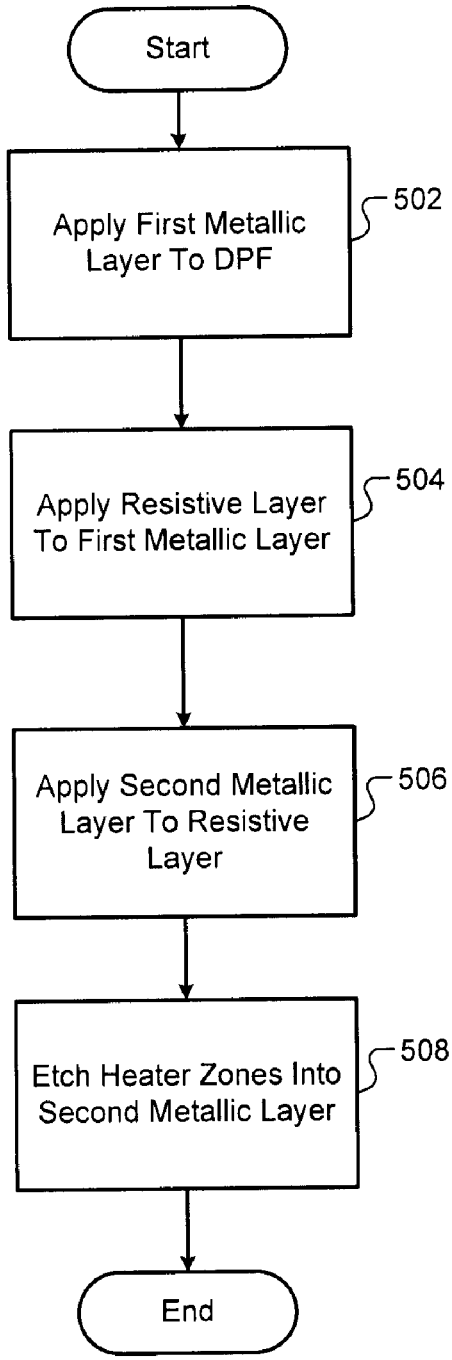

Referring now to FIG. 5, a flowchart depicting an exemplary method for making the diesel particulate filter with the zoned resistive heater assembly is presented. The method begins in step 502 where the first metallic layer 240 is applied to the DPF element 222. More specifically, the first metallic layer 240 is applied to the front section 227 of the DPF element 222. The first metallic layer 240 may be applied in any suitable manner, such as by dip-coating.

The method continues in step 504 where the resistive layer 244 is applied to the first metallic layer 240. The resistive layer 244 may be applied in any suitable manner, such as by dip-coating. The method continues in step 506 where the second metallic layer 242 is applied to the resistive layer 244. The second metallic layer 242 may be applied in any suitable manner, such as by dip-coating.

The method continues in step 508 where the zones 246 are formed. More specifically, the zones 246 are etched in the second metallic layer 242. The configuration and design of the zones 246 may be any suitable design or configuration. Etching the zones 246 into the second metallic layer 242 creates the void 248. The void 248 electrically isolates each of the zones 246 from each other zone.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A diesel particulate filter assembly comprising:

a diesel particulate filter (DPF) that filters a particulate from exhaust produced by an engine; and a heater assembly having a first metallic layer that is applied to said DPF, a resistive layer that is applied to said first metallic layer, and a second metallic layer that is applied to said resistive layer, wherein said second metallic layer is etched to form a plurality of zones.

2. The diesel particulate filter assembly of claim 1 further comprising an end plug that is inserted into said second metallic layer to close a channel of said DPF, wherein said resistive layer is disposed downstream of said end plug.

3. The diesel particulate filter assembly of claim 1 wherein said first metallic layer is applied to said DPF by dip-coating.

4. The diesel particulate filter assembly of claim 3 wherein said first metallic layer is embedded into a wall of said DPF.

5. The diesel particulate filter assembly of claim 3 wherein said resistive layer is applied to said first metallic layer by dip-coating.

6. The diesel particulate filter assembly of claim 5 wherein said second metallic layer is applied to said resistive layer by dip-coating.

7. A system comprising:

the diesel particulate filter assembly of claim 1; and a heater power module that is in electrical communication with each of said zones, and that selectively applies at least one of a voltage and a current to selected ones of said zones.

8. A method comprising:

applying a first metallic layer to a diesel particulate filter (DPF);

applying a resistive layer to said first metallic layer;

applying a second metallic layer to said resistive layer; and etching said second metallic layer into a plurality of zones.

9. The method of claim 8 further comprising inserting an end plug into said second metallic layer to close a channel of said DPF, wherein said resistive layer is disposed downstream of said end plug.

10. The method of claim 8 wherein said first metallic layer is applied to said DPF by dip-coating.

11. The method of claim 10 wherein said applying said first metallic layer to said DPF embeds said first metallic layer into a wall of said DPF.

12. The method of claim 10 wherein said resistive layer is applied to said first metallic layer by dip-coating.

13. The method of claim 12 wherein said second metallic layer is applied to said resistive layer by dip-coating.

14. The method of claim 8 further comprising:

selecting ones of said zones; and selectively applying at least one of a voltage and a current to said selected ones of said zones.

* * * * *